US006435231B1

(12) United States Patent
Cooper et al.

(10) Patent No.: US 6,435,231 B1
(45) Date of Patent: Aug. 20, 2002

(54) PACKAGING SYSTEM FOR MIXING AND DISPENSING MULTICOMPONENT PRODUCTS

(75) Inventors: Matthew Martin Derome Cooper; David Michael Healy, both of Ayr (GB)

(73) Assignee: Giltech Limited, Ayr (GB)

( * ) Notice: Subject to any disclaimer, the term of this patent is extended or adjusted under 35 U.S.C. 154(b) by 0 days.

(21) Appl. No.: 09/786,969

(22) PCT Filed: Oct. 22, 1999

(86) PCT No.: PCT/GB99/03516

§ 371 (c)(1),
(2), (4) Date: Mar. 12, 2001

(87) PCT Pub. No.: WO00/24649

PCT Pub. Date: May 4, 2000

(30) Foreign Application Priority Data

Oct. 22, 1998 (GB) ..... 9823029

(51) Int. Cl.[7] ..... B65B 1/04; B65B 3/00; B67C 3/00

(52) U.S. Cl. ..... 141/346; 141/18; 141/20; 141/107; 141/349; 141/369; 141/386

(58) Field of Search ..... 141/346–350, 141/351, 369, 370, 113, 383, 384, 386, 18, 20, 107

(56) References Cited

U.S. PATENT DOCUMENTS

| | | | | |
|---|---|---|---|---|
| 3,181,737 A | | 5/1965 | Chaucer | 222/136 |
| 3,698,453 A | | 10/1972 | Morane et al. | 141/349 |
| 4,197,884 A | * | 4/1980 | Maran | 141/383 |
| 4,576,211 A | * | 3/1986 | Valentini et al. | 141/329 |
| 4,750,314 A | * | 6/1988 | Mietz et al. | 53/470 |
| 4,988,017 A | | 1/1991 | Schrader et al. | 222/130 |

FOREIGN PATENT DOCUMENTS

| | | |
|---|---|---|
| DE | 81 12 183 | 10/1982 |
| DE | 87 04 600 | 11/1987 |
| EP | 0 217 582 A2 | 4/1987 |
| GB | 1059265 | 2/1967 |
| GB | 2 142 385 A | 1/1985 |

* cited by examiner

*Primary Examiner*—Timothy L. Maust
(74) *Attorney, Agent, or Firm*—Drinker Biddle & Reath LLP

(57) ABSTRACT

A packaging system which comprises a first container (24) having a valve (27) controlling the opening of an outlet and which contains a first ingredient (25), and a second container (28) having an openable entry portion (14) and containing a second ingredient (29). The packaging system further comprises means for connecting the first and second containers together in order to allow said first ingredient to be displaced from the first container into the second container via the entry portion thereof, so that said first and second ingredients are admixed in said second container to form a final product.

38 Claims, 20 Drawing Sheets

PACKAGING SYSTEM FOR MIXING AND DISPENSING MULTICOMPONENT PRODUCTS

The present invention relates to a packaging system for combining and dispensing a product at its point of use. The packaging system herein described is particularly useful for combining and dispensing a mixture of products.

The packaging of products is a significant consideration for manufacturers and consumers. The factors requiring consideration in selecting a particular form of packaging include the suitability of the packaging for containing the product throughout its shelf life and the ease with which the product can be dispensed.

Many household products are packaged in pressurized aerosol containers. There are three main types of aerosol containers: standard, piston and bag-in-can. Standard aerosol containers are formed from aluminum or tin plate and contain a mixture of product and pressurized propellant. A piston can is an aluminum can having the product separated from the pressurized propellant by a piston which is normally polypropylene. A bag-in-can container is formed from aluminum or tin.

Other parts of the complete aerosol device, such as the valve used and the actuator, are also selected upon their suitability having regard to the nature of the product and the type of aerosol container. The method of filling the container will also be affected similarly.

Up to now aerosol devices could only be used with products that are stable within the container and therefore have a suitable shelf-life. However, there are many materials which must be produced from two or more ingredients mixed just prior to use. Examples of such products include: glue and hardener, glass fibre resin and catalyst, epoxy paints, hair colorants and cement/concrete.

The present invention provides a packaging system having a first container containing a first ingredient and a second container containing a second ingredient, the first and second containers being adapted for connection together such that upon deployment of the packaging system the first ingredient is displaced from said first container into said second container and an admixture of said first and second ingredients is subsequently dispensed from the packaging system.

More particularly, the packaging system according to the invention comprises:

a) a first container having a valve-controlling the opening of an outlet and containing a first ingredient;

b) a second container having a openable entry portion, containing a second ingredient; and c) means for connecting the first and second containers together in order to allow the first ingredient to be displaced from the first container into the second container via the entry portion thereof, so that the first and second ingredients are admixed in the second container to form a final product.

Conveniently the passage of the first ingredient from the first container through to the second container causes the first ingredient to be intimately blended with the second ingredient.

It is preferred that the connecting means comprises a conduit to transfer said first ingredient into said second ingredient.

Preferably the containers are each pressurized aerosol containers, and the initial pressure in the second container may be less than that in the first container.

In one embodiment the first container is a piston-style aerosol container. The first ingredient is placed into the first container which is then fitted with a top valve. The first container may then be sterilized, for example by autoclave. The container is then pressurized by inserting a propellant below the piston via an aperture in the bottom of the can. A preferred propellant is nitrogen gas, but a wide variety of propellants can be used since there is no contact between the propellant and the first ingredient (these being separated by the piston). The pressurized container is then sealed with a rubber bung or other suitable means. Alternatively the first container may be a bag-in-can style aerosol container, the first ingredient being separated form the propellant by the bag.

In one embodiment the second container may be an aerosol container of known type, advantageously adapted by having as an openable entry portion a Nicholson valve or bung or other seal preferably located in the bottom thereof. An example of another seal or entry portion would be a thin portion or membrane which could be pierced open. Thus, the second container is filled with an appropriate quantity of second ingredient via the top of the can which is then closed using a standard valve. The container may be pressurized by inserting a suitable propellant (desirably an inert propellant that does not react with the first and second ingredients). Alternatively, the second container may become sufficiently pressurized by the transfer of the first ingredient.

Optionally the connecting means are also provided with means to hold the first and second containers in suitable juxtaposition.

The conduit may be a tube, preferably composed of plastics material.

In a preferred embodiment the first container is positioned beneath the second container and connected thereto via the connecting means. It is also preferred that the first container has a standard directionally biased pressure activated valve as commonly provided on an aerosol can.

Optionally the conduit cooperates with the openable entry portion of the second container so that when the entry is opened, the conduit permits entry of the first ingredient into the second container to take place.

Optionally the conduit is shaped to co-operate with the valve of the first container and preferably to open it. For example the conduit may comprise a bayonet-shaped end.

Preferably the second container has a bottom-mounted Nicholson valve or a bung which is removed or displaced into the second container by the connecting means to allow the entry of the first ingredient into the second container. Thus, in one embodiment the conduit may cooperate with the Nicholson valve located in the bottom surface of the second container and will displace the valve inwardly upon connection.

In one preferred embodiment the connecting means is shaped and sized to facilitate the admixture of the first and second ingredients within the second container. To aid suitable dispension of the first ingredient, the conduit may terminate in a blind ending and possess multiple openings (usually 2, 3 or 4) in the side of the conduit, generally adjacent the blind end thereof. In one example the conduit openings may be shaped and dimensioned to dispense the first ingredient in a spiral flow so as to promote good admixture of the first and second ingredients.

In one embodiment the connecting means comprises a first sleeve projecting downwardly which engages the top of the first container and a second sleeve projecting upwardly which engages the bottom of the second container. Thus, the first container is positioned correctly with respect to the second container via the connecting means. This sleeve, may be composed of plastics material. The conduit is carried within the aperture of the sleeve. Desirably the sleeve forms a close-fit with the first and second containers. For example, the internal surface of the sleeve may comprise a series of ridges extending circumferentially. In use the first container may be pushed past one or more of these ridges to be locked into place and cause transfer of the first ingredient to the second container via the conduit.

Advantageously, means to actuate the displacement of the first ingredient to the second container includes means to hold the first and second containers in suitable juxtaposition.

The sleeve may be used to retain the first container beneath the second container during both storage and distribution. The sleeve will also be responsible for holding the containers together such that the contents of the first container may be transferred into the second container.

Optionally the sleeve may include or be attached to an anti-tamper device.

The connecting means may be moulded from plastics material as a one piece unit. Alternatively, and desirably, the sleeve may be formed from a first and second part which are rotatable relative to each other. The first part comprises both the conduit and the first and second sleeves. The second part comprises a third sleeve which is secured to or part of the bottom of the second container. The second and third sleeves have corresponding screw threads, which allow these second and third sleeves to be moved from a first position where the conduit is not actuating the openable entry portion to a second position where said conduit actuates said openable entry when transfer of the first ingredient is required.

Thus, the sleeve parts may simply be screwed together to initiate transfer of the first ingredient. Desirably there may be a ratchet mechanism to prevent reversal of the rotation of the sleeve parts. In one embodiment the relative rotation of the sleeve parts is through approximately 120°.

Preferably each of the containers may be sterilized, for example by autoclave techniques or by irradiation.

Conveniently the second container may be filled with the second ingredient via an aperture in the bottom of the container which is then sealed, for example with a rubber bung or Nicholson valve. This seal or valve may then be pushed into the container by the connecting means upon activation.

Preferably also the second container has a top mounted actuator which controls the dispension of its contents.

Optionally each of the containers may also be adapted to dispense the ingredients contained therein in a conventional manner.

In a preferred embodiment the first ingredient is a gel, preferably a foamable gel, and the second ingredient is a powder.

In a preferred embodiment of the invention the packaging system of the present invention is designed to discharge the material described in WO-A-96/17595 of Giltech Limited wherein the powder constituent of said formulation is the second ingredient and is contained within the second container and the gel constituent of said formulation is the first ingredient and is contained within the first container.

In a preferred embodiment of the invention the connecting means is used to connect two aerosol canisters, which together contain the ingredients required to make a silver ion releasing water-soluble glass held in an alginate foam as described in WO-A-96/17595 of Giltech Limited.

In this embodiment the first container is a piston type aerosol canister, which contains a foamable gel (eg alginate) which is pressurized to approximately 130 psi, for example with nitrogen gas. The second container contains the powder ingredients of said foam (eg a water-soluble glass powder) and is pressurized to approximately 50 psi, for example with a liquified petroleum gas (eg CFC, HC, HFC propellants). However, the first container may also be a bag-in-can aerosol container where the first ingredient is separated from the propellant by a bag.

The whole apparatus may be shaken after transfer of a the first ingredient to ensure proper mixing of the first and second ingredients before the foam can be discharged. Once discharge is complete the apparatus may be discarded.

The packaging system described herein is based upon pressure differentials. When the containers are connected, if the pressure in the second container is less than that in the first container, upon connection the contents of the first container will flow into the second container as required. At equilibrium if the pressure in the second container is equal to the pressure in the first container no further transfer of material will take place. If the pressure in the second container is greater than the pressure in the first container the contents of the second container could flow back into the first container. This flow can however be prevented by the use of a one way valve at the top of the first container.

The propellant selected for the second container is usually an excipient of the final product, which is produced by mixing the contents of the first container with the second container. The excipient is a substance conveniently used as a medium or a vehicle for administering the final product. It is advantageously a gas which does not react with the first and second ingredients. However, if a barrier type canister is used as the first container, the propellant used for the first container will not be introduced into the second container. It will not therefore affect the final product.

If a liquified gas is used as the propellant in the second container, the vapour pressure of this gas can be determined by mixing quantities of liquified gases at various vapour pressures until the desired pressure is reached. Vapour pressure is that pressure at which the closed system is at equilibrium.

This can be explained in more detail as follows: If a known volume of liquid gas is introduced into a vacuum at a given temperature T the liquified gas will boil and vaporize to occupy all of the available space in the container. The pressure in the container will rise as the gas expands. At equilibrium the remaining liquified gas will not have enough energy to vaporize and the pressure of the gaseous phase is not high enough to cause condensation of the gas. This equilibrium point can be measured as a stable pressure reading at the valve or entry point. A reduction in the volume of the container will lead to an increase in the volume of liquified gas and vice versa, but the pressure will remain constant at a given temperature.

The liquified gas propellants give a constant pressure throughout the expulsion of products. They can also readily dispense thicker product more easily than compressed gas as their pressure will not decrease until all the liquid phase propellant has been expelled.

If a pressurized gas (air, nitrogen, etc) was used in the second container then the pressure fill would have to be lower than the first container to allow for a pressure increase when product is introduced from the first container. If the pressure equalizes during the transfer flow of product will cease. As the product is dispensed the pressure in the second container will decrease and dispersion will be slowed.

If the first container and the second container are standard aerosol canisters with no barrier type system, product and propellant from the first container will flow into the second container until equilibrium is reached in the two containers.

The principles of the present invention could be used to mix contents from virtually any number of containers (so long as there is an appropriate pressure difference between one container and the next).

The connection means of the present invention thus provides a means for mixing the contents of two or more separate aerosol containers together in one of the aforementioned aerosol containers. This is particularly useful when an aerosol dispenser is required to dispense a mixture of ingredients that would otherwise be too unstable to be stored in just one single aerosol container.

The packaging system of the invention may comprise more than two containers which are successively connected together with connection means. Advantageously, each container would be appropriately pressurized to drive its contents into the next container following activation of the connecting means linking the two containers together, to form an admixture. Thus, the contents of the initial container will be transferred to its immediate neighbour and the admixture so formed will be subsequently transferred to the next container of the series. This process will be repeated until the final container contains the full admixture which can then be dispensed.

Embodiments of present invention will now be described by way of example and with reference to the accompanying drawings, in which.

Figure 5:
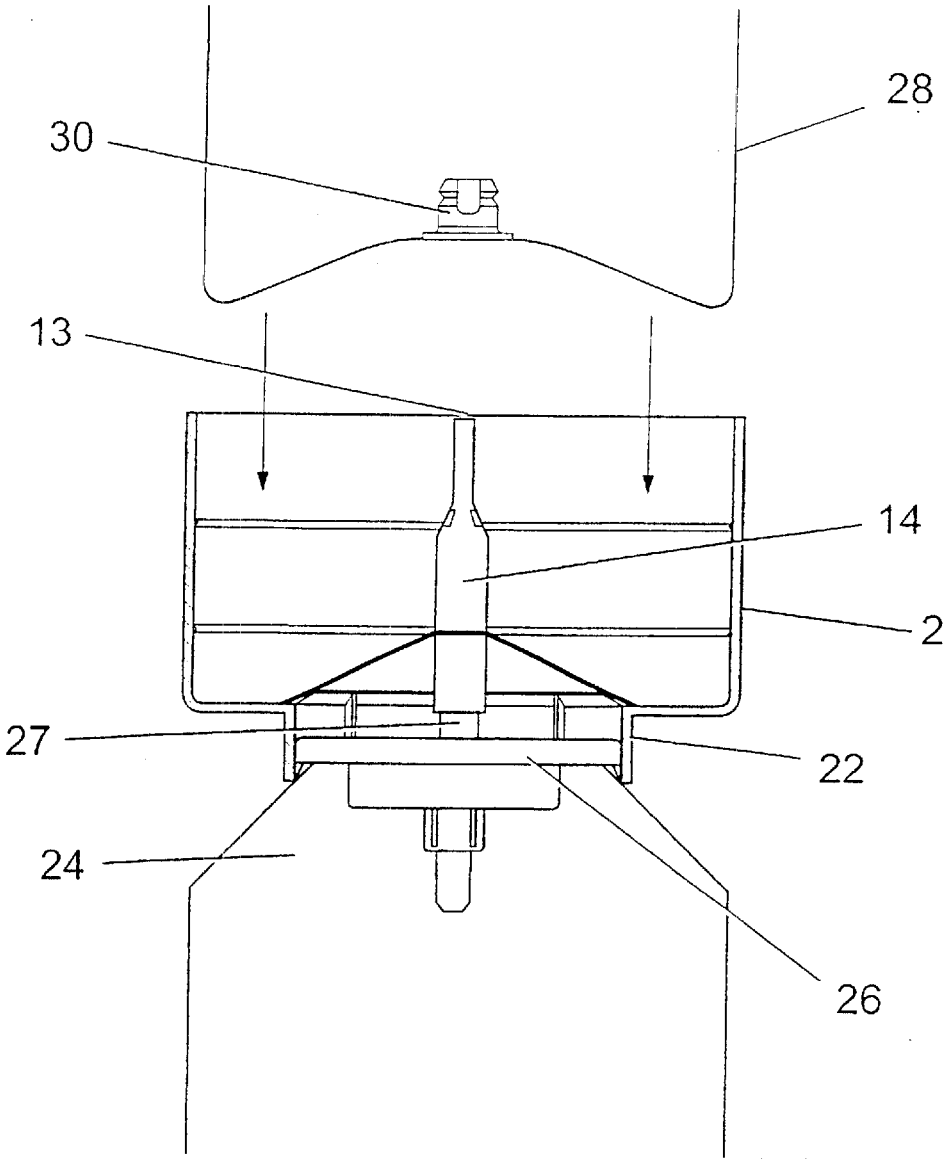
FIG. 5 is a cross-sectional view of the connecting means of FIGS. 1 to 4 attached to a first container and ready to receive a second container.
Figure 6:
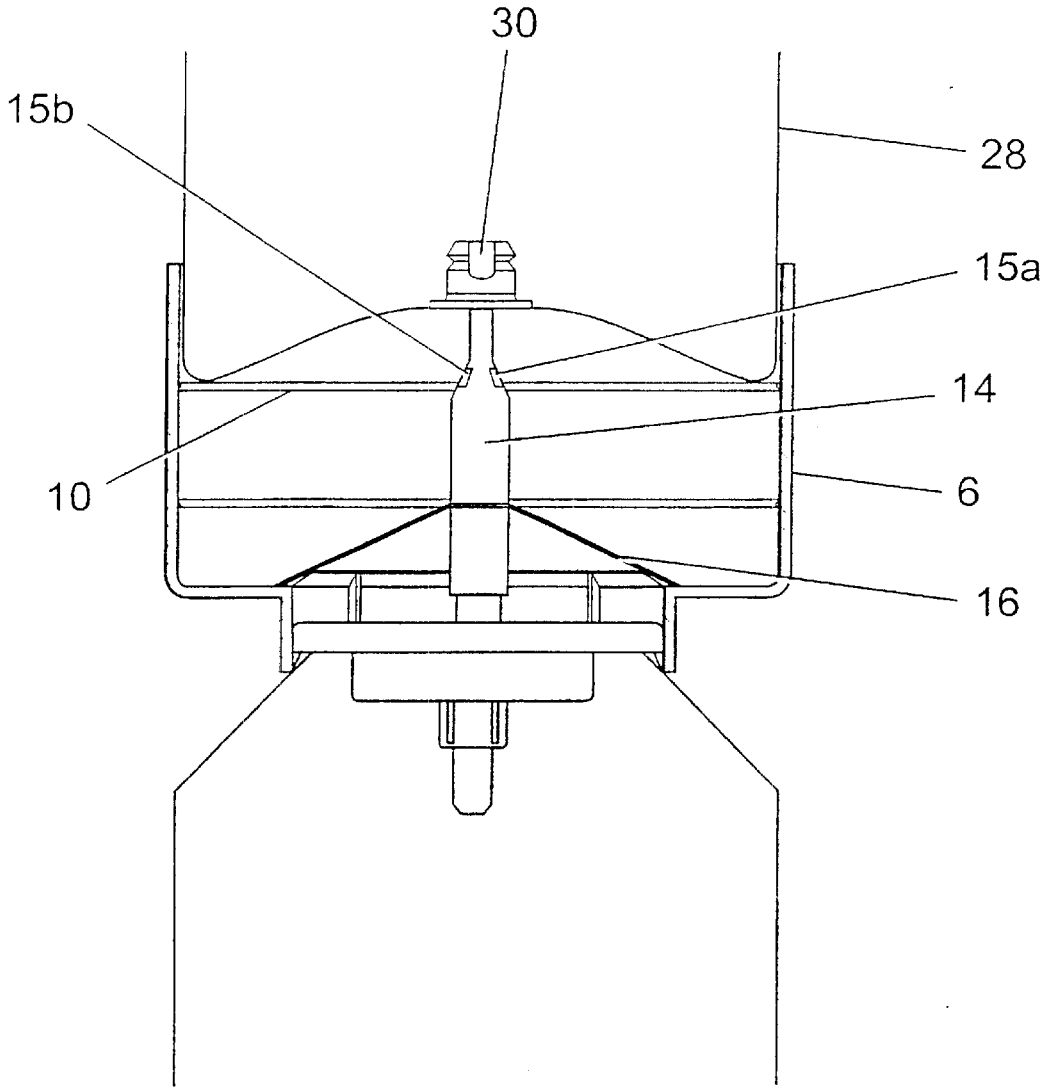
FIG. 6 shows in cross-section the packaging system of FIG. 5 attached to a second container in storage mode.
Figure 7:
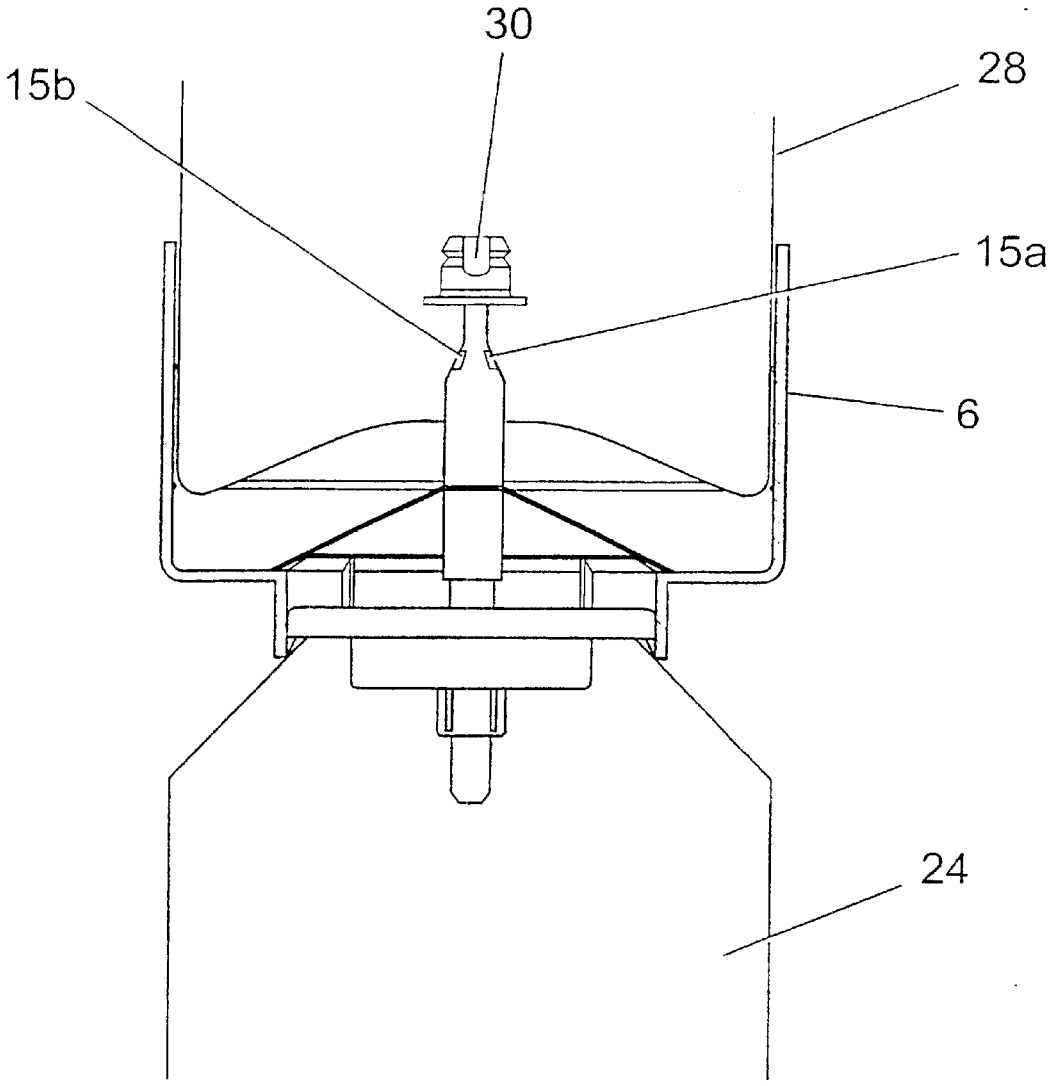
FIG. 7 shows in cross-section the packaging system of FIG. 6 in dispensing mode.
Figure 8:
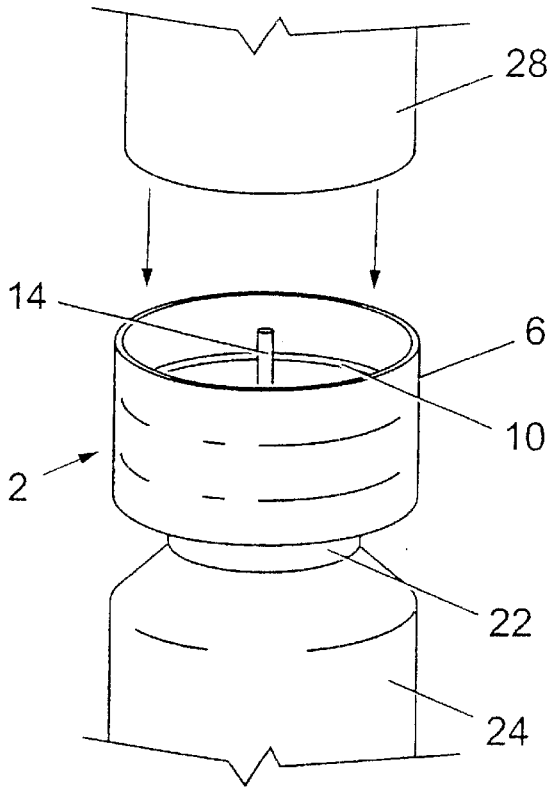
Figure 9:
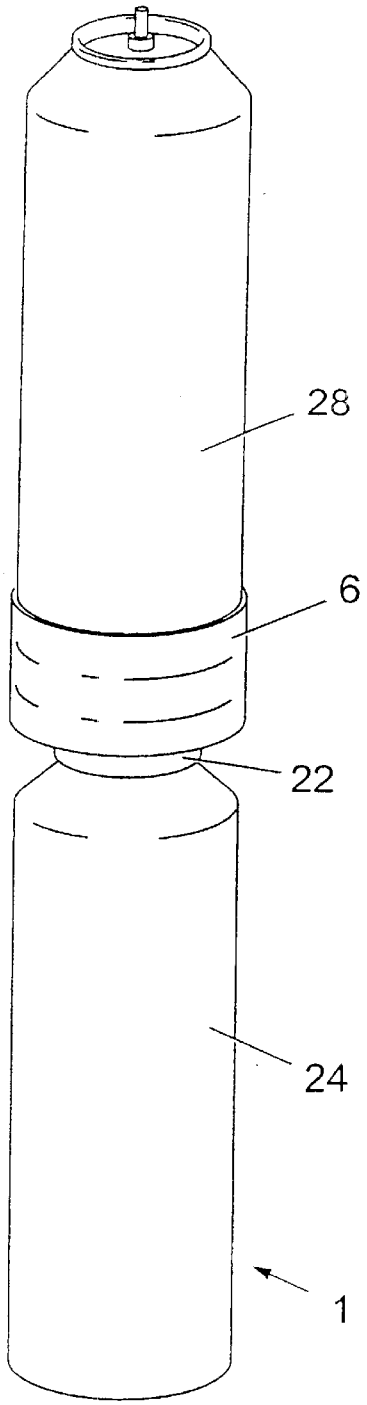
Figure 10:
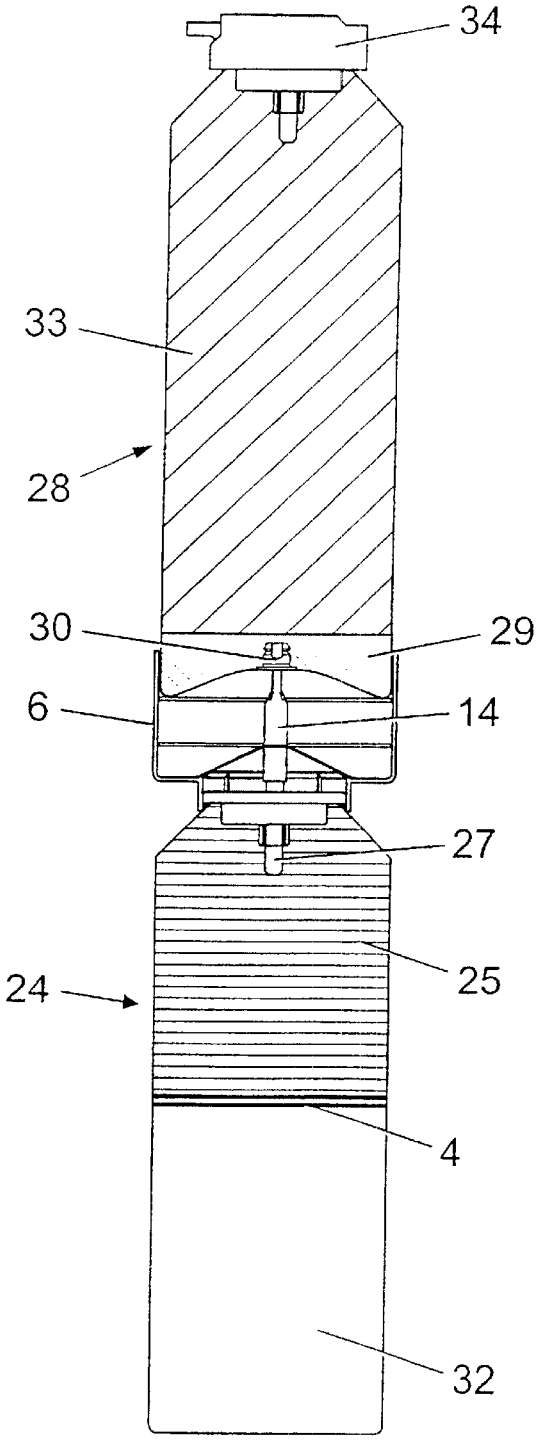
Figure 11:
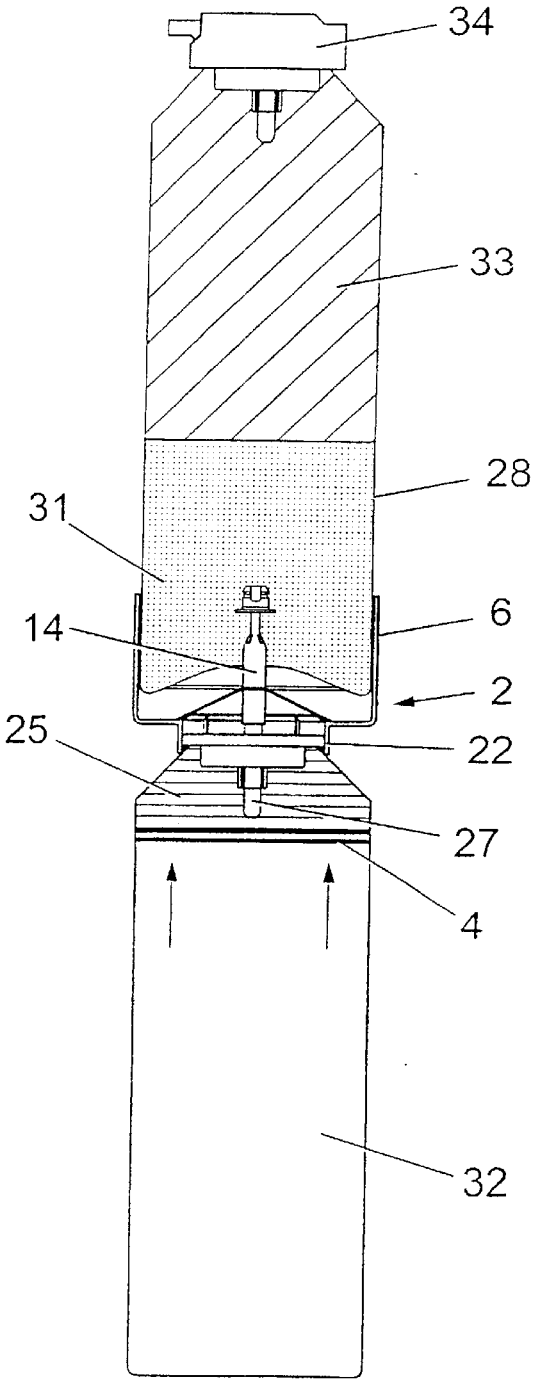
Figure 12:
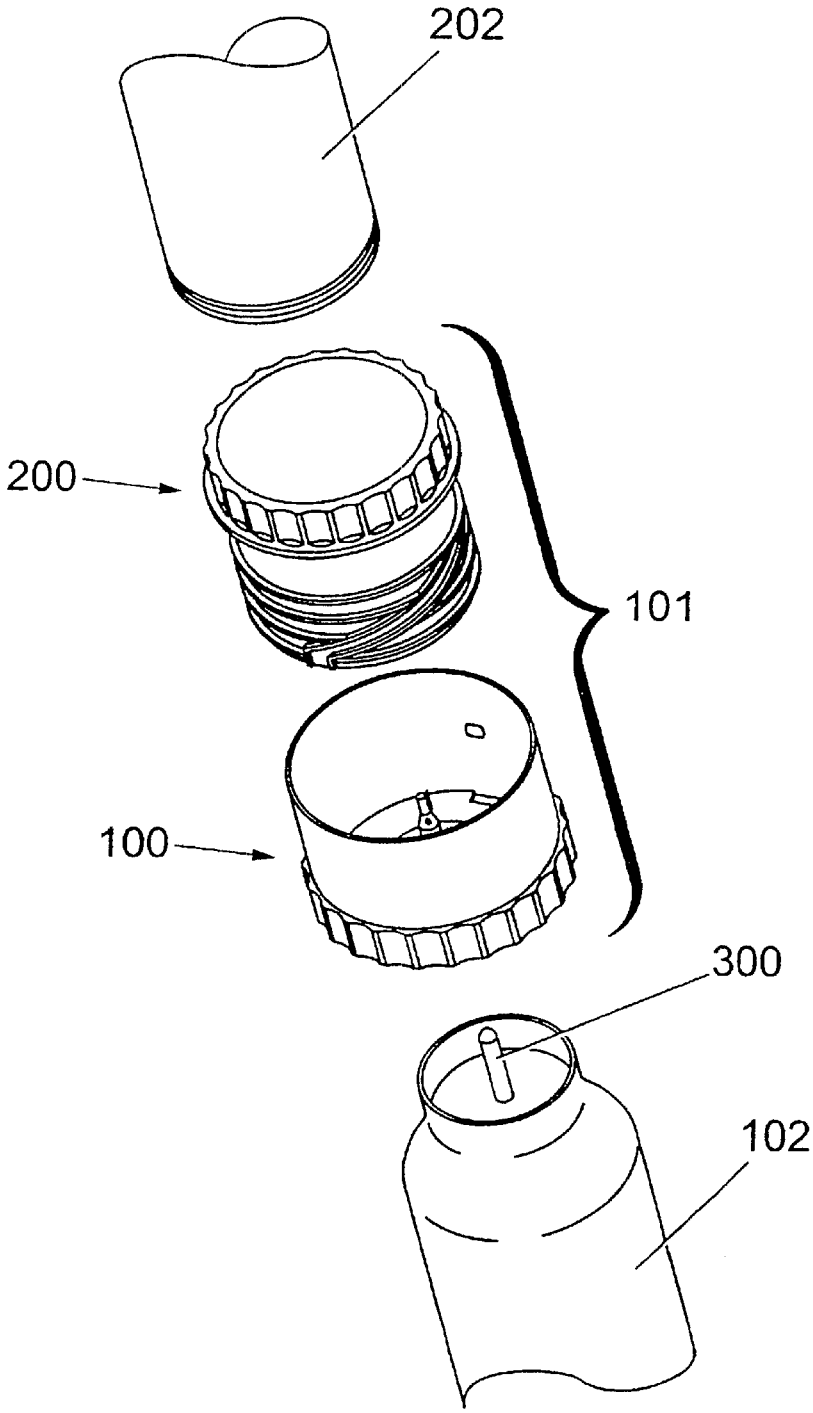
Figure 13:
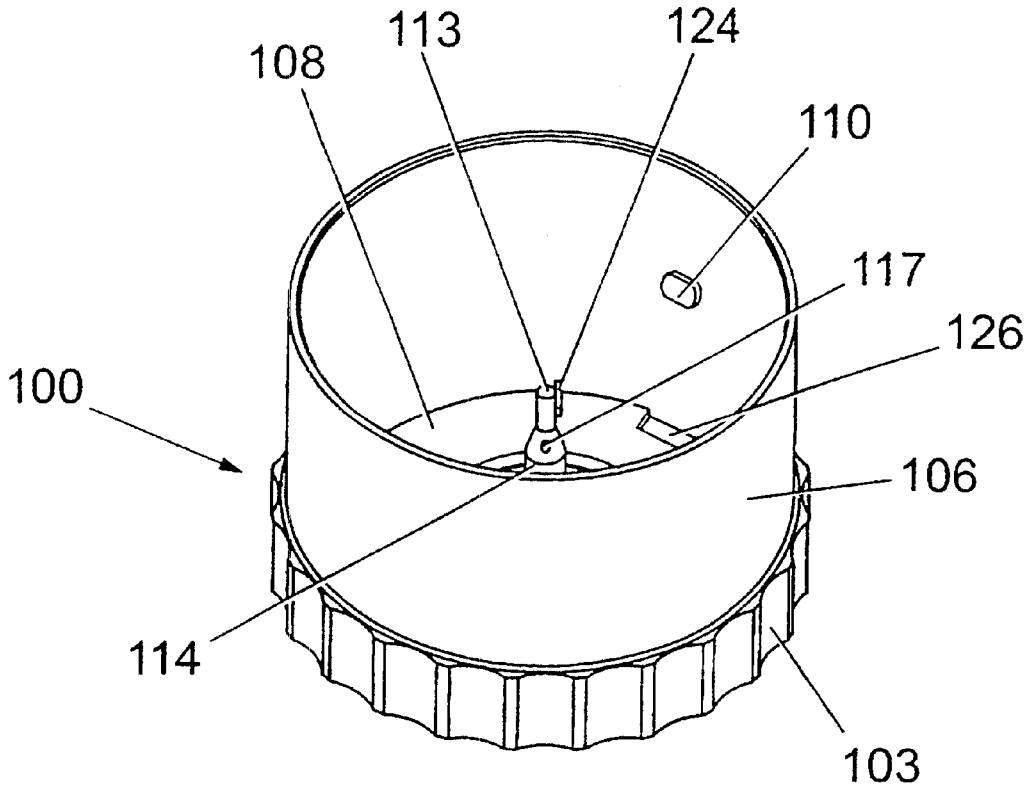
Figure 14:
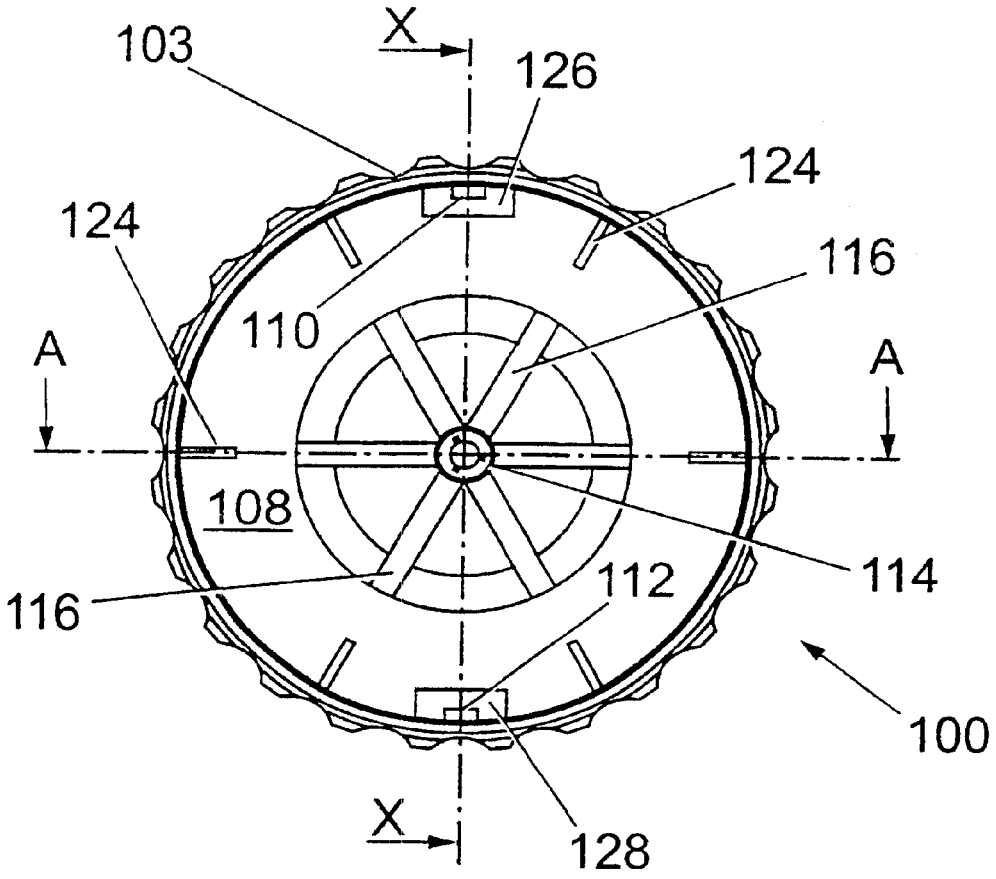
Figure 15:
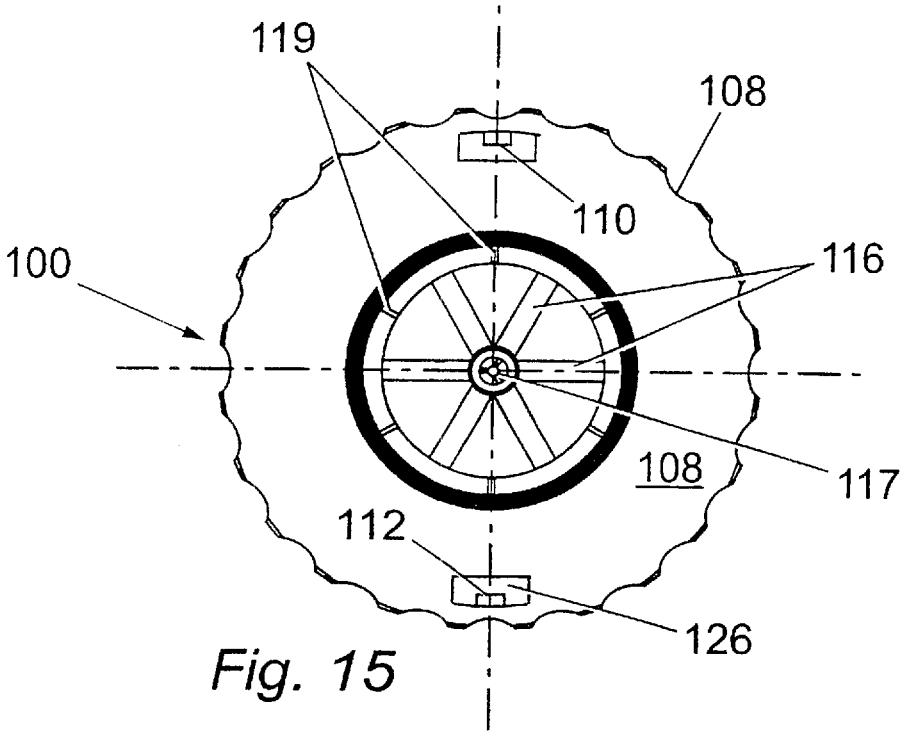
Figure 16:
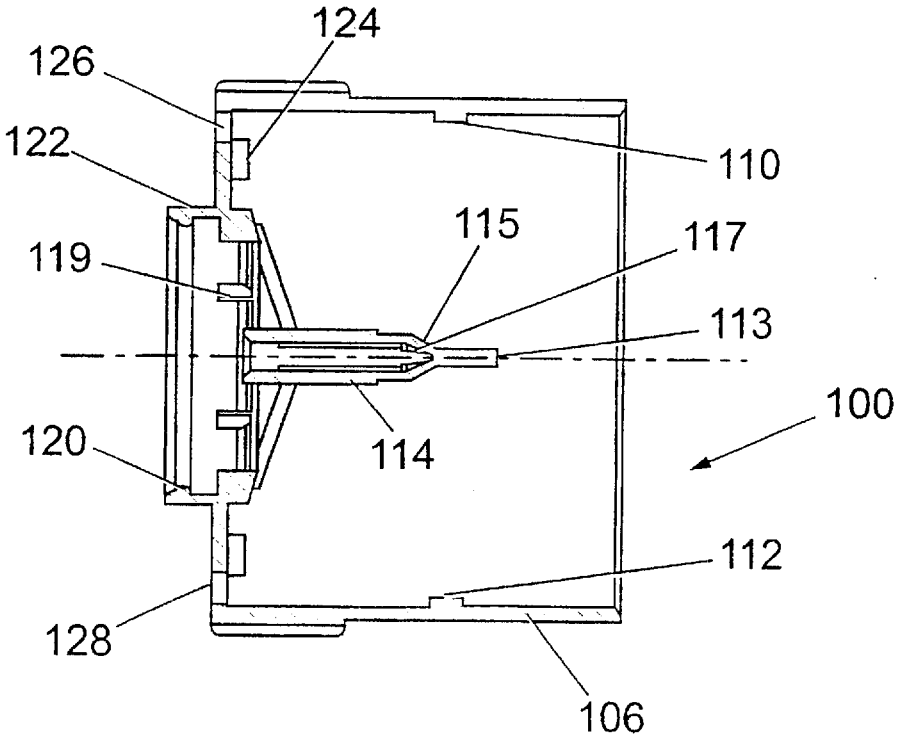
Figure 17A:
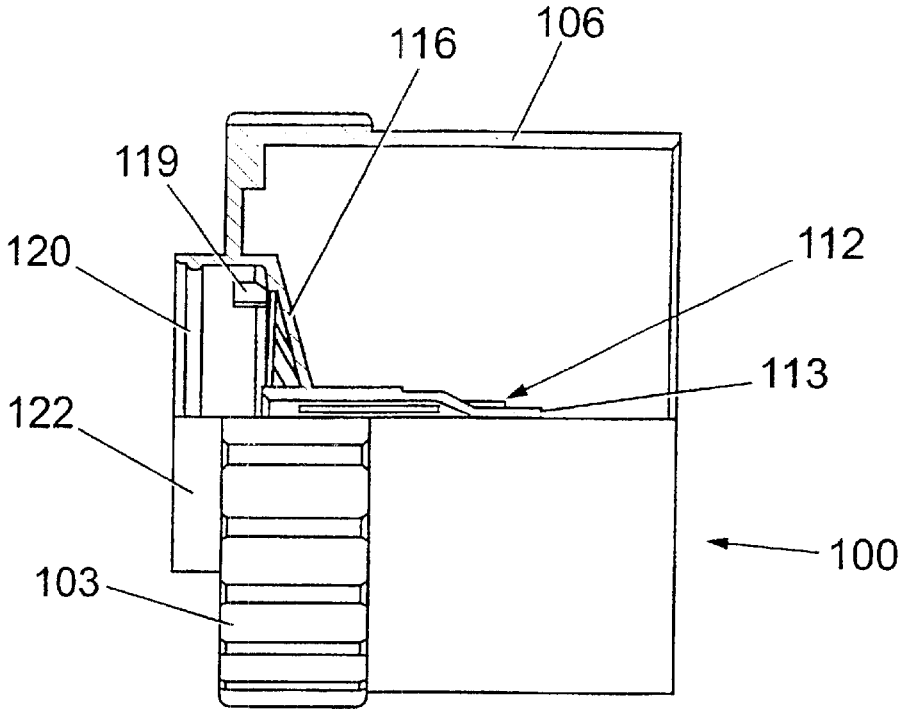
Figure 17B:
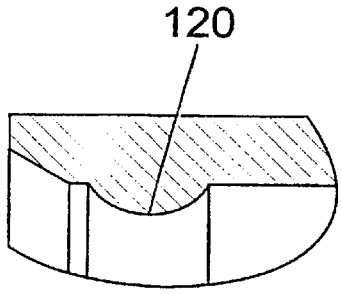

FIG. 8. is a perspective view of the packaging system showing the connecting means of FIGS. 1 to 7 attached to a first container and ready to receive a second container (equivalent to FIG. 5);

FIG. 9 is a perspective view of the dispensing system attached to a first container and a second container, as the complete apparatus would be stored or transported;

FIG. 10 is a cross-sectional view of one embodiment of the invention, when the connecting means is attached to two aerosol canisters in storage mode and indicating the contents of the two containers schematically;

FIG. 11 is a cross-sectional view of the embodiment of FIG. 10, with the canisters are in dispensing mode and indicating the contents of the two containers schematically;

FIG. 12 is a partial and exploded perspective view of a second embodiment of a connecting means of this invention showing a two-part connector;

FIG. 13 is a perspective view of the first part of the connector shown in FIG. 12;

FIG. 14 is the first part of the connector shown in FIG. 13 viewed from above;

FIG. 15 is the first part of the connector shown in FIG. 13 viewed from below;

FIG. 16 is a cross-sectional view of the first part of the connector shown in FIG. 14 along the line X—X;

FIG. 17*a* is a side view of the first part of the connector shown partial cross-section (along line A—A of FIG. 14);

FIG. 17*b* is an enlarged detail (scale 1:5) of snap bead 120 of the connector shown in FIG. 17*a;*

Figure 17C:
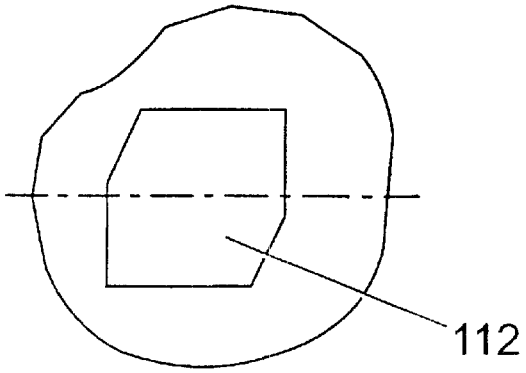

FIG. 17*c* is an enlarged detail (scale 1:5) of protuberance 112 of the connector shown in FIG. 17*a;*

Figure 18:
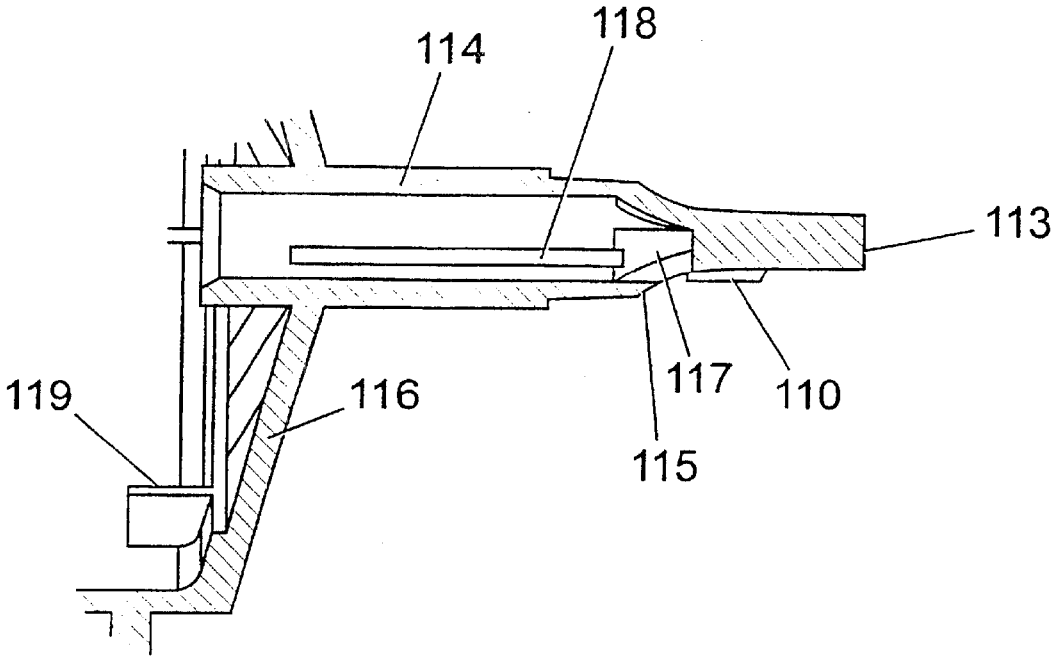
Figure 19:
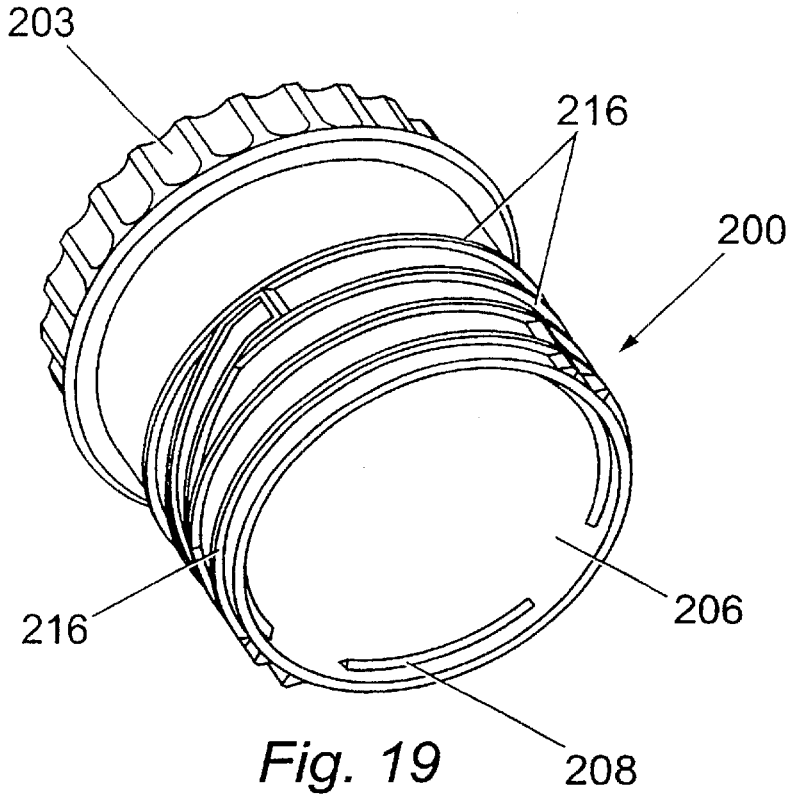
Figure 20:
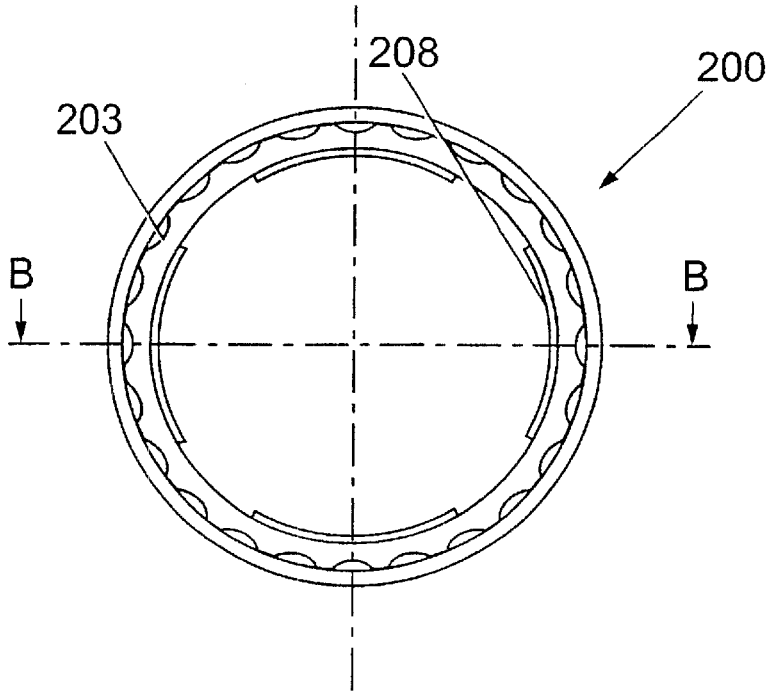
Figure 21A:
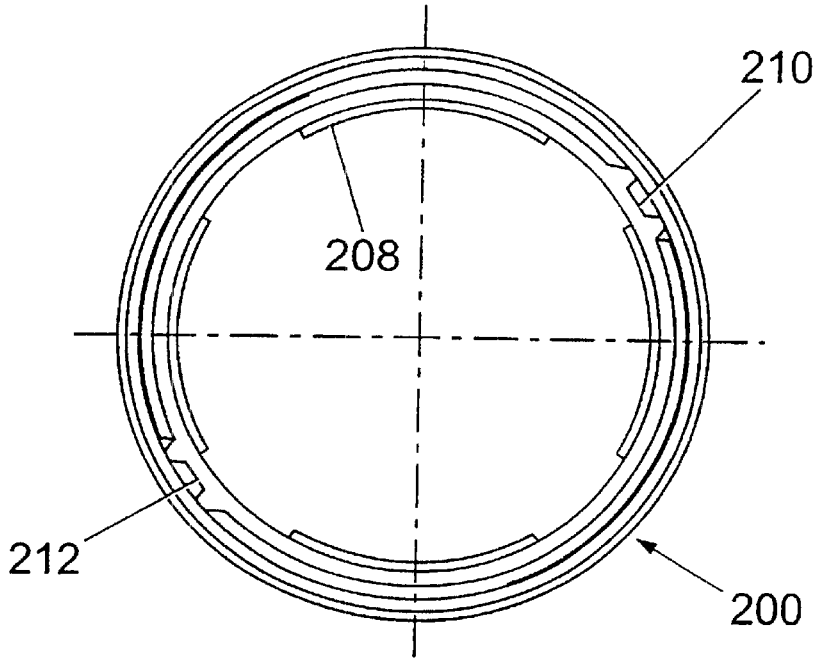
Figure 21B:
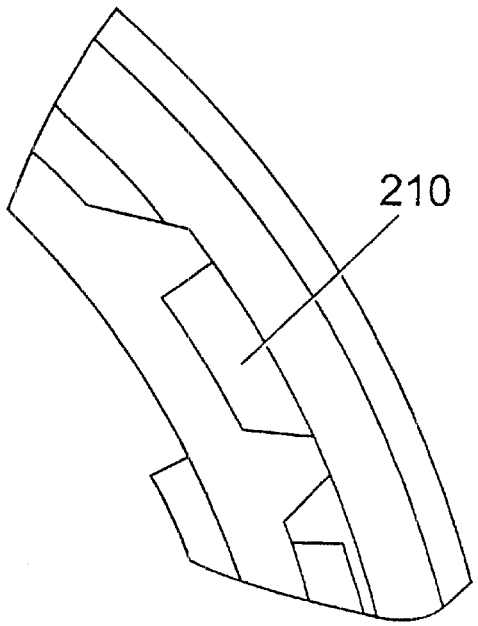
Figure 22:
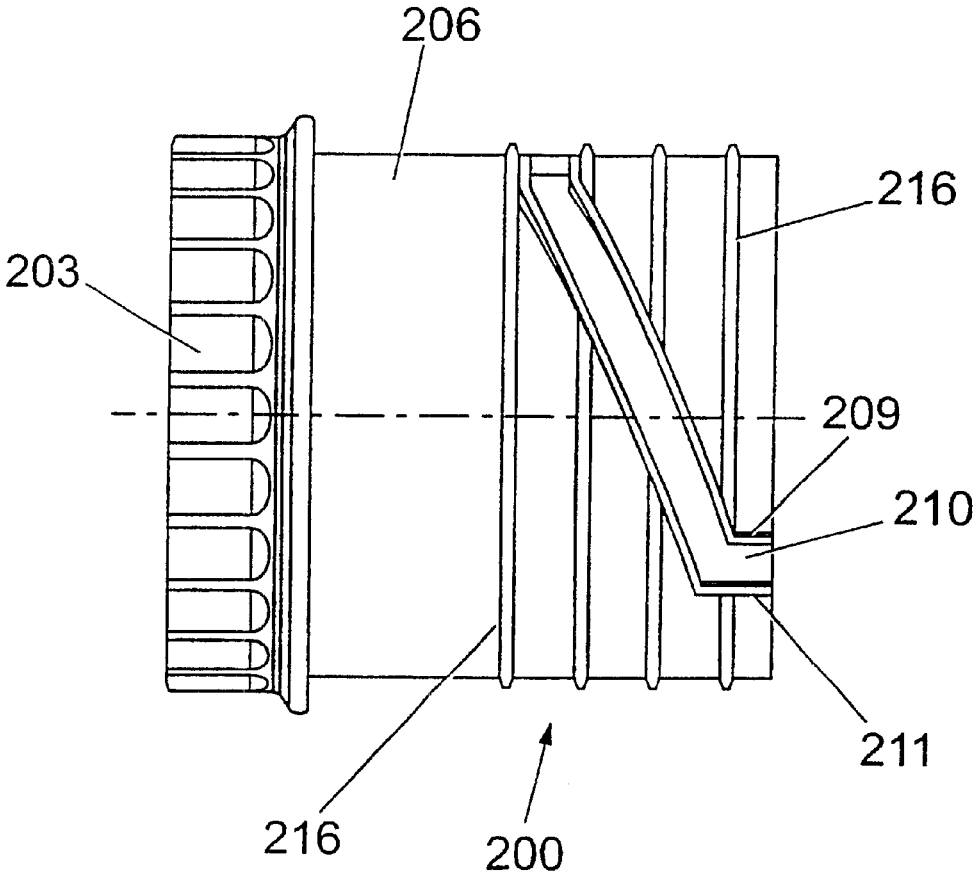
Figure 23A:
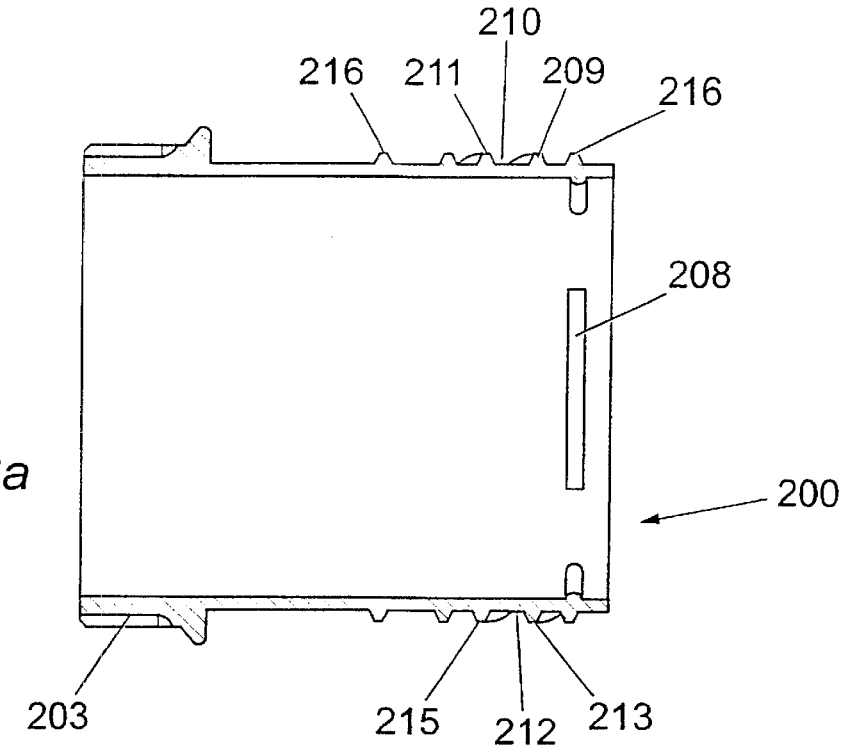
Figure 23B:
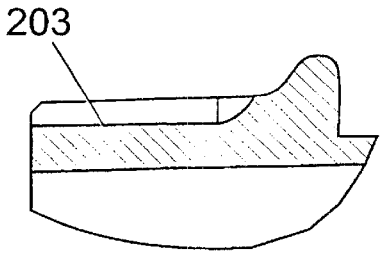

FIG. 18 is an enlarged partial cross-sectional view (scale 2:1) of the first part of the connector shown in FIG. 14 and taken along the line A—A;

FIG. 19 is a perspective view of the second part of the connector shown in FIG. 12;

FIG. 20 is the second part of the connector shown in FIG. 19 viewed from above;

FIG. 21*a* is the second part of the connector shown in FIG. 19 viewed from below;

FIG. 21*b* shows an enlarged detail (scale 5:1) of the track 210 of the connector shown in FIG. 19;

FIG. 22 is a side view of the second part of the connector shown in FIG. 19;

FIG. 23*a* is a cross-sectional view of the second part of the connector shown in FIG. 20 along line B—B;

FIG. 23*b* is an enlarged detail (scale 2:1) of the knurl of the connector shown in FIG. 23*a;*

Figure 23C:
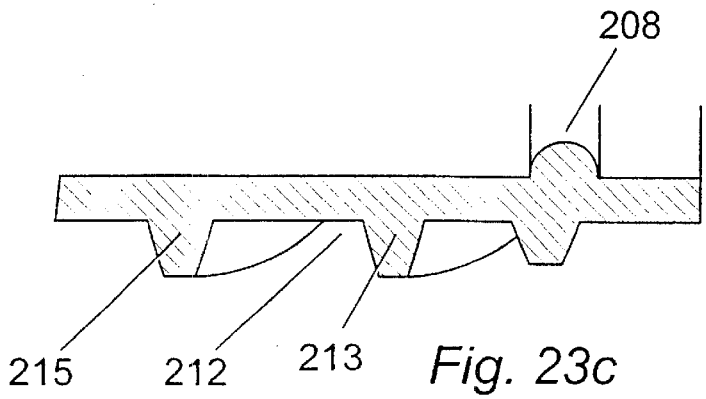

FIG. 23*c* is an enlarged detail (scale 5:1) of the pathway 212 of the connector shown in FIG. 23*a;*

Figure 24:
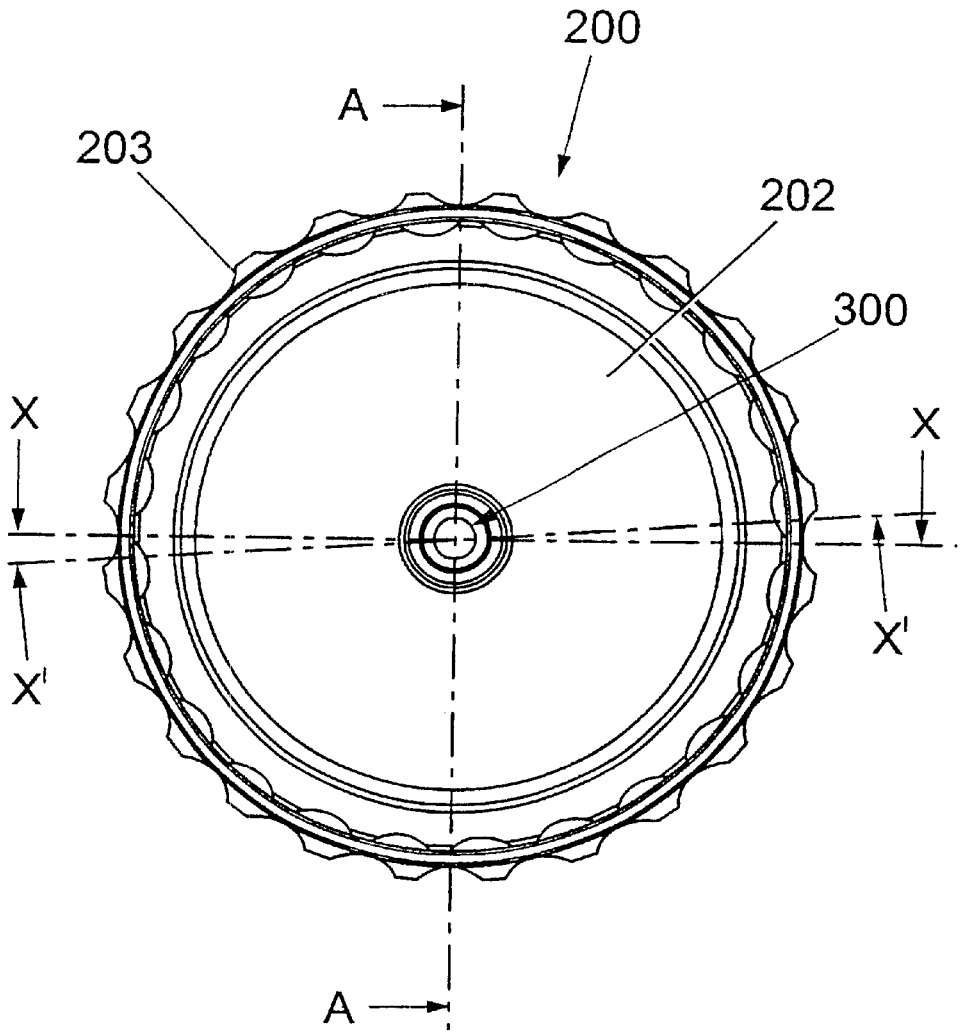
Figure 25:
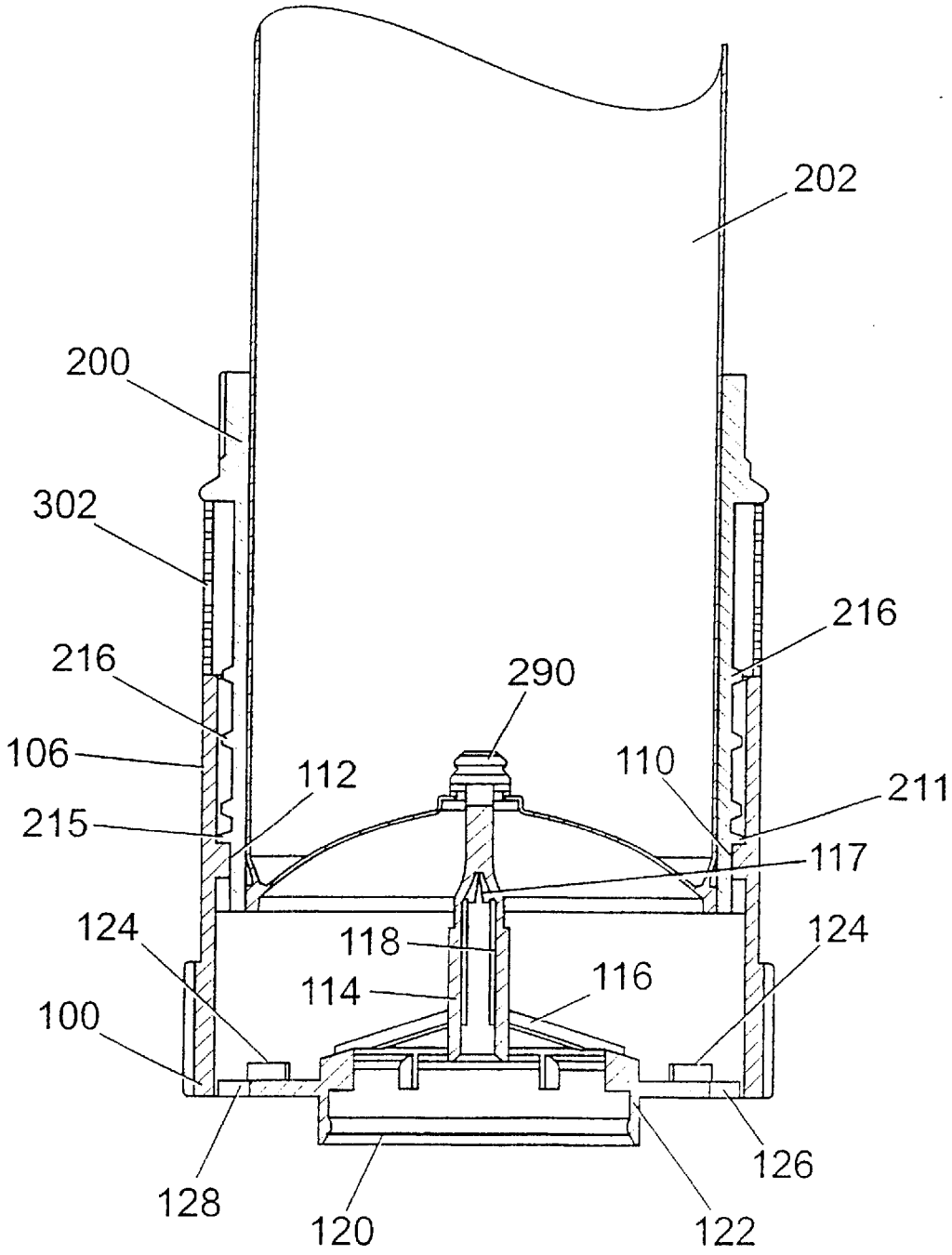
Figure 26:
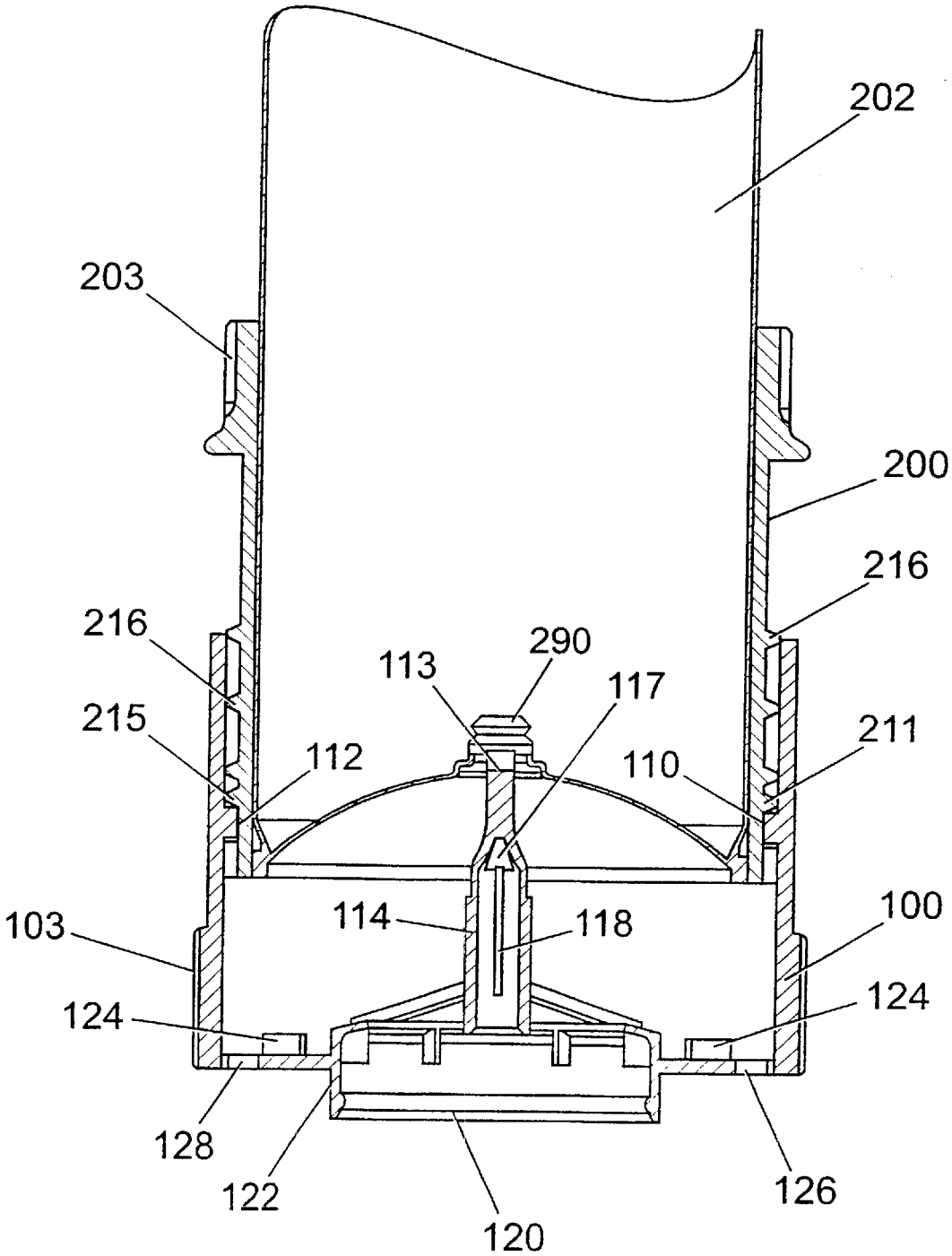
Figure 27:
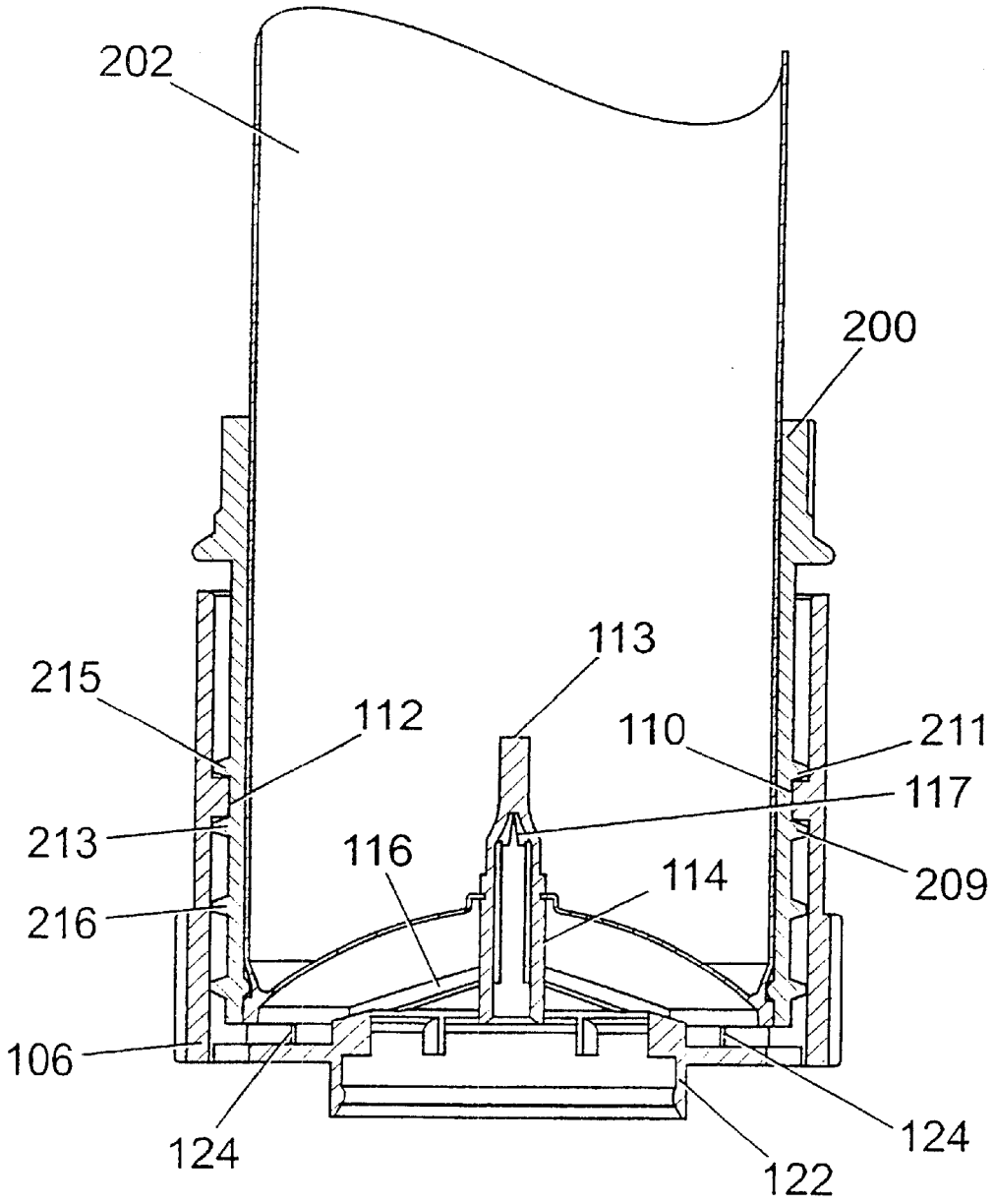

FIG. 24 is the second part of the connector of FIG. 19 shown attached to a second container and viewed from above;

FIG. 25 is a longitudinal and cross-sectional view along line X—X of FIG. 24 of the connecting means shown in FIG. 12 in storage mode, and wherein a second container is shown attached to the second part of the connector, the two parts of the connector being connected together in a storage mode and with a tamper band provided;

FIG. 26 is a cross-sectional view similar to FIG. 25 except that the tamper band has been removed and that the cross sectional view is taken along line X'—X' of FIG. 24; and FIG. 27 is a cross-sectional view similar to FIG. 25 except that the two parts of the connector have been positioned in dispensing mode and that the view is taken along lines A—A of FIG. 24.

In more detail, FIGS. 1–4 show the connecting means 2 of the present invention, which is preferably formed from a single piece of plastics material. The connecting means 2 comprises a cylindrically shaped sleeve 6 having at its bottom edge an inwardly projecting and essentially horizontal shelf 8. The inner edge of shelf 8 projects downwardly to form a sleeve 22 having a smaller internal diameter than major sleeve 6. The internal diameter of sleeve 6 is chosen to form a close fit with the second container of the invention. As illustrated two circumferentially extending ridges 10, 12 are located on the internal surface of sleeve 6 to promote a good grip between connecting means 2 and the second container (not shown).

The internal diameter of smaller sleeve 22 is chosen to form a close fit with the top of first container of the present invention, which may conveniently be a conventionally sized neck collar of a commercially available aerosol canister.

Figure 2:
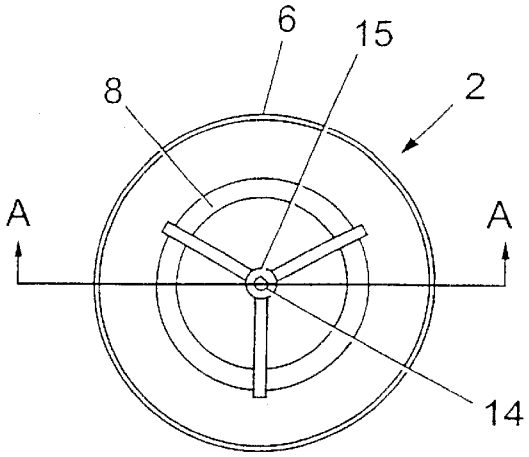
FIG. 2 is a plan view from above of the connecting means of FIG. 1.
Figure 3:
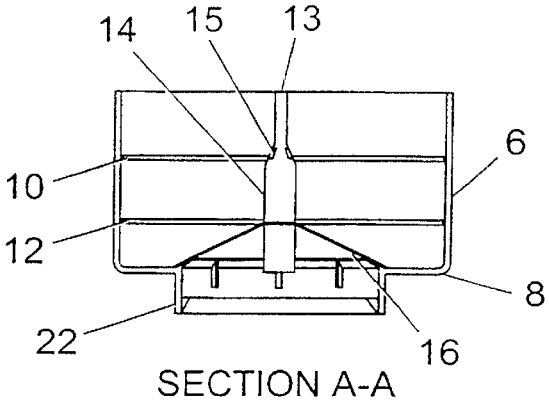
FIG. 3 is a cross-section of the connecting means of FIG. 2 taken along line A—A.
Figure 1:
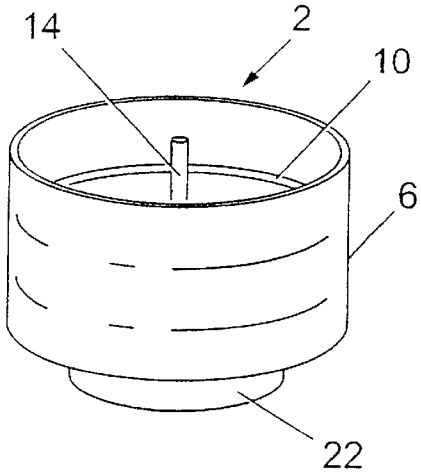
FIG. 1 is a perspective view of a first embodiment of the connecting means of this invention.
Figure 4:
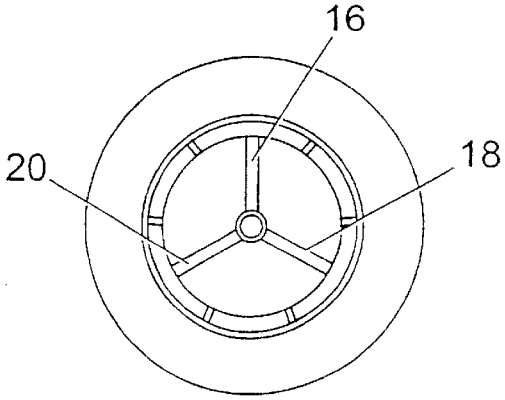
FIG. 4 is a plan view from below of the connecting means of FIGS. 1 to 3.

FIGS. 1–4 show a conduit extending through sleeve 6 at approximately the center thereof. The conduit 14 is supported at its lower end by projections 16, 18 and 20 which extend from the inner edge of shelf 8 to the conduit. In the embodiment illustrated only three projections are shown, but more projections may also be present. Preferably the projections are spaced equidistantly from each other. As is best seen in FIG. 3, the aperture of conduit 14 narrows at shoulder 15, the upper narrow portion of conduit 14 terminating in a blind ending 13. Small apertures 15*a*, 15*b*, 15*c* are present in conduit 14 and spaced equidistantly around shoulder 15. These apertures 15*a*, 15*b* and 15*c* are best seen in FIGS. 5–7.

FIGS. 5–7 and 8–9 demonstrate how connecting means 2 may be used to connect the first and second containers. As shown in FIG. 5 the connecting means 2 can be pressed on to the first container 24, the inner surface of sleeve 22 forming a close fit with the external diameter of neck collar 26 on container 24. The internal diameter of the lower portion of conduit 14 is chosen to form a close fit with the standard valve 27 of container 24. FIG. 5 shows a second container 28, having been aligned with connecting means 2, moving in the direction of the arrows in order to connect therewith.

As shown in FIG. 6, the second container 28 is then located within the upper portion of sleeve 6 and the packaging system may be stored and/or transported in this position. In this position the bottom of container 28 is pushed as far as ridge 10 and the blind end 13 of conduit 14 is located directly beneath and abuts the Nicholson valve 30 sealing the bottom of the second container 28.

Downward pressure is applied until the bottom of the second container 28 abuts ridge 10 of the sleeve 6 and the top of conduit 14 abuts the seal or Nicholson valve 30. This is the storage/distribution mode of the packaging system 1.

In order to activate the packaging system of the present invention and to initiate transfer of the first ingredient from the first container 24 into the second container 28, the second container is moved relative to the connecting means 2 into the position illustrated in FIG. 7. As shown in FIG. 7, conduit 14 has partially penetrated into the interior of container 28, the seal or Nicholson valve 30 being pushed inwardly and, as illustrated, retained upon the blind end 13 of conduit 14. The valve 27 of first container 24 is activated by pushing that container, and thus valve 27, into conduit 14 as far as shoulder 15. The presence of shoulder 15 in conduit 14 causes the valve 27 to be activated and the pressure within the first container 24 is released, the propellant therein expanding and causing displacement of the first ingredient along the conduit 14, through apertures 15*a*, 15*b* and 15*c* and into the interior of the second container 28. Desirably, the apertures 15*a*, 15*b*, 15*c* are shaped, dimensioned and spaced to cause the first ingredient to be introduced into the interior of second container 28 in a spiral motion (eg having vortex characteristics) which causes admixture of the first and second ingredients.

FIG. 8 illustrates a connecting means 2 positioned onto a first container 24 and ready to receive the second container 28 which is moving in the direction of the arrows.

FIG. 9 illustrates the first and second containers 24, 25 held in vertical juxtaposition by connecting means 2. Moving the second container 28 in a downward motion would cause activation of the upper valve 27, (shown in FIGS. 10 and 11) on the first container 24 and displacement of the first ingredient into the second container 28. Activation of the valve 34 (not shown) on top of the second container 28 would then allow dispension of the admixture of the first and second ingredients. As the packaging system 1 of the present invention is designed specifically to aid dispension of ingredients which are normally incompatible during storage, complete deployment of the device would normally occur shortly after transfer of the first ingredient into the second container.

FIGS. 10 and 11 show in schematic cross-section, the transfer of the first ingredient 25 from the first container 24 into the second container 28, to form an admixture 29 with the second ingredient. As shown, the first container 24 initially contains the first ingredient 25 (for example a foamable gel) separated from a pressurized propellant 32 (such as nitrogen gas/liquid system) by a piston 4. Upon activation of valve 27 located at the top of container 24, as caused by the relative movement of containers 24, 28 together, the pressure of container 24 is released and propellant 32 expands driving a piston 4 upwardly and pushing first ingredient 25 through valve 27, conduit 14 and into the interior of the second container 28 via apertures 15*a*, 15*b* and 15*c*.

In the embodiment illustrated in FIGS. 10 and 11, the second container 28 initially holds the second ingredient 29 (which may be for example a powdered active ingredient) and a gas/liquid pressure system of a propellant 33. Initially the propellant 33 comprises a significant volume of propellant in gaseous form, but upon the introduction of the first ingredient 25, at least part of the gaseous propellant is converted into liquid. In FIG. 11 the first and second ingredients have formed an intimate admixture 31. Admixture 31 is dispelled from the packaging system 1 by activation of valve 34 located on the upper end of container 28.

Referring now to FIGS. 12 to 27 there is shown a second preferred embodiment of the invention wherein the connecting means is a two-part connector 101. As shown in the exploded view of FIG. 12 the connector 101 has a first part 100 which is designed to be immovably attached to a first container provided with a standard valve 300 and a second part 200 which is designed to be immovably attached to a second container 202.

FIGS. 13 to 18 show the details of the first part 100 of the connector 101. More particularly FIGS. 13 to 18 illustrate that the first part 100 comprises a cylindrically shaped sleeve 106 having at its bottom edge an inwardly projecting and essentially horizontal shelf 108. The internal diameter of sleeve 106 is chosen to co-operate with the second part 200 of connector 101 of the invention.

The shelf 108 is pierced by apertures 126, 128 which are each provided below protuberances 110 and 112 located on the inner wall of the sleeve 106. Advantageously abutments 124 are provided on the upper surface of the. shelf 108, projecting upwardly from the latter and inwardly from the inner wall of the sleeve 106. These abutments 124 limit the extent of insertion of the second part 200 of the connector 101 when the second part 200 is introduced into the sleeve 106.

Of course, whilst the embodiment illustrated contains six abutments 124 arranged equidistantly around shelf 108, fewer or greater numbers of abutments 124 may be present if desired. Preferably the abutments 124 are spaced equidistantly from each other.

As illustrated in FIGS. 13–17, two protuberances 110, 112 are located on the internal surface of sleeve 106 and these form a part of a locking system between the two parts 100 and 200 of the connector 101 which will be further described below. FIG. 17C shows in detail a preferred shape of protuberance 112. A corresponding shape would be used for the other protuberance 110.

A fluted band 103, which can be made of equidistantly spaced ribs, is provided around the outer surface of the sleeve 106 and advantageously provides a good gripping surface for the user.

As best shown in FIG. 16, the inner edge of shelf 108 projects downwardly to form a sleeve 122 having a smaller internal diameter that sleeve 106. The internal diameter of sleeve 122 is chosen to form a close fit with the top of the first container 102 which may conveniently be a conventionally sized neck collar of a commercially available aerosol canister. A snap bead 120, best shown in FIG. 17, is advantageously provided at the bottom edge of the sleeve 122 to provide improved fitting with the neck collar of the first container 102.

At the upper portion of sleeve 122 a number of small ribs 119, best shown in FIGS. 15, 16 and 18, are positioned projecting downwardly into the aperture of sleeve 122 and which are preferably equidistantly spaced from each other. These small ribs 119 act both as reinforcing members and spacing abutments with respect to the top of the first container 102.

FIGS. 13 to 18 illustrate a conduit 114 extending partially along the aperture sleeve 106 and located at approximately the center thereof. The conduit 114 is supported at its lower end by six (preferably identical) projections 116 which extend from the inner edge of shelf 108 to the conduit 114. Of course, greater or fewer numbers of projections 116 may be present if desired. Preferably the projections 116 are spaced equidistantly from each other.

The internal diameter of the conduit 114 is chosen to form a close fit with the dispensing tube of the first container 102 which is conveniently sized and shaped as a commercially available aerosol canister dispensing tube. Alternatively, the lower end of conduit 114 may terminate in an adaptor which is able to form the required close fit. Longitudinal reinforcing ribs 118 (shown in FIG. 18) are present on the inner wall of conduit 114 and may extend substantially along the length of the interior of conduit 114. Preferably there are three equidistantly spaced ribs 118.

As it is best seen in FIGS. 16 and 18, the thickness of the wall of conduit 114 may narrow at shoulder 115 reducing the external diameter whilst maintaining the aperture diameter. The upper portion of conduit 114 then terminates in a blind ending 113 which is of smaller cross-sectional area than conduit 114. Small apertures 117 are located in and spaced equidistantly around conduit 114. The apertures are located between shoulder 115 and blind end 113, and in this portion of conduit 114 narrows further, sloping inwardly to the blind end 113. As best shown in FIG. 15, the embodiment illustrated has three apertures 117 but this can of course be varied if required.

FIGS. 19 to 24 show the details of the second part 200 of the connector 101.

The second part 200 of the connector 101 is sized and shaped to be located onto the bottom of a second container 202 in a tight fit arrangement. The second container 202 is sealed on its bottom surface by a bung 290 (for example a rubber bung or Nicholson valve) (see FIGS. 25–27).

As illustrated in FIG. 19, the second part 200 comprises a cylindrically shaped sleeve 206 having at its inner bottom edge several ribs 208 which project inwardly into the aperture of sleeve 206 and are of arcuate form. The internal diameter of sleeve 206 is chosen to form a close fit with the bottom of the second container 202. Advantageously the second part of the connector 101 is sized and shaped to receive the bottom of the second container in a close fit manner. The ribs 208 act as an additional attachment means and cooperate with the bottom end of the second container 202 in a snap bead manner.

The external diameter of sleeve 206 is chosen to be generally smaller than the internal diameter of sleeve 106 of the first part 100 of the connector 101. However the external diameter of the bottom part of the sleeve 206 is chosen so as to be generally larger than the internal diameter (taking into account the width of the protuberances 110, 112 of the locking system) of sleeve 106. For example, in this particular embodiment, the bottom end of the external surface of the sleeve 206 is provided with several successive curved and protruding ribs 216 which increase the external diameter of the sleeve 206.

Two other sets of ribs 209, 211 and 213, 215 which define two pathways or tracks 210 (shown in FIGS. 21–22) and 212 along the external surface of the bottom part of the sleeve 206 interrupt the ribs 216. Such pathways 210, 212 are sized and positioned to engage the two corresponding protuberances 110 and 112 provided inside the sleeve 106. Upon rotation of at least one of the two parts 100 or 200 of the connector 101, the protuberances 110, 112 are located at the entrance of their respective pathway 210, 212. Upon further rotation associated with reasonable pressure applied to the each or both parts 100, 200 of the connector 101 the protuberances 110, 112 are moved further along the pathways 210, 212 until the sleeve 206 becomes further positioned within the sleeve 106 to a pre-set maximum distance and the two parts 100, 200 of the connector 101 become locked together at a given position which is determined by the pathways 210 and 212. In this primed position, the blind end 113 has been pushed against the bung or Nicholson 290 valve sealing the bottom surface of the second container, displacing the bung or Nicholson valve 290 inwardly into the interior of that container 202. In this position apertures 117 are located within the cavity of container 202 such that material dispensed from container 102 would be dispensed therethrough.

Desirably when the two parts 100, 200 of the connector are in the primed position it is not possible to simply rotate these parts in the opposite direction to unlock them from each other, but rather the shape and size of protuberances 110, 112 and pathways 210, 212 means that the two connectors become firmly "locked" together.

Preferably the ribs 209, 211, 213, 215 and 216 which are provided on the external surface of the bottom end of the sleeve 206 are of a given width which allows close fitting of the sleeves 106, 206 of the two parts 100, 200 of the connector 101.

As best shown in FIG. 22 fluted band 203 may be provided externally on the upper portion of the sleeve 206 to provide a good grip for the user's hand.

FIGS. 25 to 27 show the first part 100 and the second part 200 attached to the second container 202 in different connecting positions.

The first part 100 can be pressed on to the first container 102, the inner surface of sleeve 122 forming a close fit with the external diameter of the neck collar provided on the first container 102 (not shown in FIGS. 25 to 27). The internal diameter of the lower portion of conduit 114 is chosen to form a close fit with the standard valve 300 of container 102 (shown in FIG. 12 and which may be similar to the valve 27 of the previous embodiment (see FIG. 5).

FIGS. 25 to 27 show three positions that can be adopted by the connecting means 101, namely storage position, ready to be connected position and dispersing position. In FIGS. 25 to 27 only a portion of container 202 is shown, and the first container 102 is not represented.

FIG. 25 shows the connecting means 101 and a second container 202, attached to the second part 200 of the connector 101. Part 200 is positioned inside sleeve 106 of the first part 100, but the locking protuberances 110, 112 are not aligned with the entrance of the pathways 210 and 212 (not shown in that Figure). In the position illustrated the blind end 113 of conduit 114 is located directly beneath and abuts the bung or Nicholson valve 290 sealing the bottom of the second container 202. A tamper band 302 can be provided between the two parts 100, 200 of the connector 101 in order to maintain them in that position and so that the packaging system may be then stored and/or transported without disturbance. This is the storage/distribution mode of the packaging system according to this embodiment of the invention.

To connect the two containers 102, 202 together the tamper band 302 has to be removed as shown in FIG. 26.

As shown in FIG. 27, and explained above, upon rotation of at least one of the parts 100, 200 of the connector 101 the locking protuberances 110, 112 are positioned facing the corresponding pathways 210, 212. Upon further rotation and appliance of reasonable pressure the bottom of second container 202 is then pushed as far as the end of pathways 210, 212. Apertures 126, 128 in the shelf 108 of the first part 100 of the connector permit the air present in the space between the two parts 100, 200 of the connector 101 to evacuate quickly.

The conduit 114 is thus forced against bung or Nicholson valve 290, displacing it inwardly into the interior of container 202 and the packaging system of the present invention is ready for use. The transfer of the first ingredient from the first container 102 into the second container 202 may then be initiated, when required, simply by pressing the first container 102 against the connector 101, thus actuating the valve 300 of container 102 and causing transfer of the first ingredient into the second container via conduit 114 and apertures 117.

Desirably, the apertures 117 are shaped, sized and spaced to cause the first ingredient to be introduced into the interior of the second container 202 in a spiral motion (eg having vortex characteristics) which causes admixture of the first and second ingredients.

The second container 202 is advantageously provided at its upper end with any suitable kind of dispensing system which permit the user to obtain the desired mixture of the two elements.

What is claimed is:

1. A packaging system comprising:

a) a first container having a valve controlling the opening of an outlet and containing a first ingredient; and b) a second container having an openable entry portion, containing a second ingredient; and c) a connecting means comprising a conduit for connecting said first and second containers together in order to allow said first ingredient to be displaced from said first container into the second container via the entry portion thereof, and wherein said conduit has openings which are shaped and dimensioned to dispense the first ingredient in a spiral flow so as to promote admixture of the first and second ingredients in the second container to form a formal product.

2. A packaging system as claimed in claim 1, wherein said first and second containers are each pressurized aerosol containers and wherein the initial pressure in the second container is less than that in the first container.

3. A packaging system as claimed in claim 1, wherein said conduit terminates in a blind ending and possesses multiple openings in the side of said conduit, generally adjacent the blind ending thereof.

4. A packaging system as claimed in claim 1, wherein said openable entry portion is located in the bottom of said second container.

5. A packaging system as claimed in claim 1, wherein said openable entry portion is a Nicholson valve or a bung.

6. A packaging system as claimed in claim 1, wherein said first container is positioned beneath the second container and connected thereto via the connecting means.

7. A packaging system as claimed in claim 1, wherein said conduit is shaped to co-operate with the valve of the first container.

8. A packaging system as claimed in claim 1, wherein said valve of said first container is a directionally biased pressure activated valve.

9. A packaging system as claimed in claim 1, wherein said connecting means comprises a first sleeve projecting downwardly which engages the top of the first container and a second sleeve projecting upwardly which engages the bottom of the second container.

10. A packaging system as claimed in claim 9, wherein said first and second sleeves are sized and shaped to form a close fit with each of said containers.

11. A packaging system as claimed in claim 1, wherein said connecting means is a one piece unit.

12. A packaging system as claimed in claim 9, wherein said connecting means comprises at least a first part and a second part which are rotatable relative to each other, said first part comprising said conduit and said first and second sleeves, and said second part comprising a third sleeve secured to the bottom of the second container, said second and third sleeves having corresponding screw threads, allowing said second and third sleeves to be moved from a first position where the conduit is not actuating said openable entry portion to a second position where said conduit actuates said openable entry portion.

13. A packaging system as claimed in claim 12, wherein said connecting means comprises a ratchet mechanism to prevent reversal of the rotation of the first and second parts.

14. A packaging system as claimed in claim 12, wherein said rotation of the first and second parts relative to each other is through approximately 120°.

15. A packaging system as claimed in claim 1, wherein said second container has a top mounted actuator which controls the dispension of its contents.

16. A packaging system as claimed in claim 1, wherein said second ingredient is a powder and wherein said first ingredient is a gel.

17. A packaging system as claimed in claim 1, wherein the outlet of said first container is a one-way valve.

18. A packaging system as claimed in claim 1, wherein said second container contains a propellant which is also an excipient of the final product.

19. A packaging system as claimed in claim 1, wherein said connecting means is made of plastics material.

20. A packaging system as claimed in claim 1, wherein said first container is chosen from the group consisting of a piston-style aerosol container where said first ingredient is separated from the propellant gas by a piston and a bag-in-can aerosol container where the first ingredient is separated from the propellant by a bag.

21. A packaging system as claimed in claim 1, wherein said second container contains a propellant gas which does not react with the first and second ingredients.

22. A packaging system as claimed in claim 1, wherein the conduit cooperates with said openable entry portion of the second container so that when the openable entry portion is opened, the conduit permits entry of the first ingredient into the second container to take place.

23. A packaging system as claimed in claim 1, wherein the second container has a bottom-mounted Nicholson valve which is removed or displaced into the second container by said conduit to allow the entry of the first ingredient into the second container.

24. A packaging system as claimed in claim 1, wherein means to actuate the displacement of said first ingredient to said second container comprises means to hold the first and second containers in suitable juxtaposition.

25. A packaging system comprising:

a) a first container having a valve controlling the opening of an outlet and containing a first ingredient; and b) a second container having an openable entry portion, containing a second ingredient; and c) a connecting means for connecting said first and second containers together in order to allow said first ingredient to be displaced from said first container into the second container via the entry portion thereof, so that said first and second ingredients are admixed in said second container to form a final product, wherein said connecting means comprises:

i) a first sleeve projecting downwardly which engages the top of the first container and a second sleeve projecting upwardly which engages the bottom of the second container; and ii) at least a first part and a second part which are rotatable relative to each other, said first part comprising said conduit and said first and second sleeves, and said second part comprising a third sleeve secured to the bottom of the second container, said second and third sleeves having corresponding screw threads, allowing said second and third sleeves to be moved from a first position where the conduit is not actuating said openable entry portion to a second position where said conduit actuates said openable entry portion; and iii) a ratchet mechanism to prevent reversal of the rotation of the first and second parts.

26. A packaging system as claimed in claim 25, wherein said first and second containers are each pressurized aerosol containers and wherein the initial pressure in the second container is less than that in the first container.

27. A packaging system as claimed in claim 25, wherein said valve of said first container is a directionally biased pressure activated valve.

28. A packaging system as claimed in claim 25, wherein said connecting means comprises a conduit which terminates in a blind ending and possesses multiple openings in the side of said conduit, generally adjacent the blind ending thereof.

29. A packaging system as claimed in claim 25, wherein the connecting means comprises a conduit which has openings shaped and dimensioned to dispense the first ingredient in a spiral flow so as to promote admixture of the first and second ingredients.

30. A packaging system as claimed in claim 25, wherein said second ingredient is a powder and wherein said first ingredient is a gel.

31. A packaging system as claimed in claim 25, wherein the connecting means comprises a conduit which co-operates with said openable entry portion of the second container so that when the openable entry portion is opened, the conduit permits entry of the first ingredient into the second container to take place.

32. A packaging system comprising:

a) a first container having a valve controlling the opening of an outlet and containing a first ingredient; and b) a second container having an openable entry portion, containing a second ingredient; and c) a connecting means comprising a conduit for connecting said first and second containers together in order to allow said first ingredient to be displaced from said first container into the second container via the entry portion thereof, so that said first and second ingredients are admixed in said second container to form a final product, wherein the second container has a bottom-mounted Nicholson valve which is removed or displaced into the second container by said conduit to allow the entry of the first ingredient into the second container.

33. A packaging system as claimed in claim 32, wherein said first and second containers are each pressurized aerosol containers and wherein the initial pressure in the second container is less than that in the first container.

34. A packaging system as claimed in claim 32, wherein said valve of said first container is a directionally biased pressure activated valve.

35. A packaging system as claimed in claim 32, wherein said conduit terminates in a blind ending and possesses multiple openings in the side of said conduit, generally adjacent the blind ending thereof.

36. A packaging system as claimed in claim 32, wherein the conduit has openings which are shaped and dimensioned to dispense the first ingredient in a spiral flow so as to promote admixture of the first and second ingredients.

37. A packaging system as claimed in claim 32, wherein said second ingredient is a powder and wherein said first ingredient is a gel.

38. A packaging system as claimed in claim 32, wherein the conduit co-operates with said openable entry portion of the second container so that when the openable entry portion is opened, the conduit permits entry of the first ingredient into the second container to take place.

* * * * *

UNITED STATES PATENT AND TRADEMARK OFFICE

CERTIFICATE OF CORRECTION

PATENT NO. : 6,435,231 B1
DATED : August 20, 2002
INVENTOR(S) : Cooper et al.

It is certified that error appears in the above-identified patent and that said Letters Patent is hereby corrected as shown below:

Column 11,
Line 45, change “formal” to -- final --.

Signed and Sealed this

Fourth Day of March, 2003

JAMES E. ROGAN
*Director of the United States Patent and Trademark Office*